United States Patent [19]

Baird, Jr. et al.

[11] 4,119,528

[45] Oct. 10, 1978

[54] HYDROCONVERSION OF RESIDUA WITH POTASSIUM SULFIDE

[75] Inventors: William C. Baird, Jr.; Roby Bearden, Jr., both of Baton Rouge, La.

[73] Assignee: Exxon Research & Engineering Co., Linden, N.J.

[21] Appl. No.: 820,820

[22] Filed: Aug. 1, 1977

[51] Int. Cl.[2] ..... C10G 13/06; B01J 23/04; B01J 23/90

[52] U.S. Cl. ..... 208/108; 208/143; 208/209; 208/235; 252/411 R; 252/436; 252/476; 423/199; 423/560; 423/DIG. 12

[58] Field of Search ..... 208/108

[56] References Cited

U.S. PATENT DOCUMENTS

| | | | |
|---|---|---|---|
| 1,938,672 | 12/1933 | Ruthruff | 208/230 |
| 2,950,245 | 8/1960 | Thomsen | 208/348 |
| 3,354,081 | 11/1967 | Aldridge | 208/235 |
| 3,788,978 | 1/1974 | Bearden et al. | 208/208 M |
| 3,976,559 | 8/1976 | Bearden et al. | 208/89 |
| 4,003,823 | 1/1977 | Baird et al. | 208/108 |
| 4,007,109 | 2/1977 | Baird et al. | 208/108 |

*Primary Examiner*—Delbert E. Gantz
*Assistant Examiner*—G. E. Schmitkons
*Attorney, Agent, or Firm*—Marthe L. Gibbons

[57] ABSTRACT

A process for the simultaneous desulfurization and hydroconversion of heavy carbonaceous feeds, including various sulfur-containing heavy petroleum oils, is disclosed. These feedstocks are contacted with potassium sulfide in a conversion zone maintained at elevated temperatures and in the presence of added hydrogen. In this manner, the feeds are substantially desulfurized, and significant upgrading of these feeds is also obtained as demonstrated by decreased Conradson carbon, increased API gravity, and the conversion of substantial portion of the 1,050° F.+ portion of these feeds. In a preferred embodiment, such a process is disclosed employing a combination of potassium sulfide and sodium sulfide, and in particular these processes include procedures for the regeneration of the sulfides and their recycle to the conversion zone.

13 Claims, 2 Drawing Figures

HYDROCONVERSION OF RESIDUA WITH POTASSIUM SULFIDE

FIELD OF THE INVENTION

The present invention relates to processes for the combined desulfurization and hydroconversion of sulfur-containing hydrocarbon feedstocks. More particularly, the present invention relates to processes for the combined desulfurization and hydroconversion of heavy hydrocarbon feedstocks in the presence of alkali metal compounds. Still more particularly, the present invention relates to processes for combined desulfurization and hydroconversion of sulfur-containing heavy hydrocarbon feedstocks in the presence of desulfurization agents wherein the desulfurization agents are regenerated and recycled therein.

DESCRIPTION OF THE PRIOR ART

In view of the large amounts of heavy sulfur-bearing oils which are currently being employed as raw materials in the petroleum refining industry, problems of air pollution, particularly with regard to sulfur-oxide emissions, have become of increasing concern. It has thus become increasingly desirable to find efficient means for upgrading these feeds with respect to both sulfur removal and conversion, i.e. wherein materials boiling above 1050° F. are converted to materials boiling below that temperature and coke-forming precursors and Conradson carbon content are converted to liquid products. For this and other reasons, various methods for sulfur removal from these feedstocks have been the subject of intensive research efforts in this industry. At present, the most practical means of desulfurizing such fuel oils is the catalytic hydrogenation of sulfur-containing molecules and petroleum hydrocarbon feeds in order to effect the removal, as hydrogen sulfide, of these sulfur-containing molecules. These processes generally require relatively high hydrogen pressures, ranging from about 700 to 3,000 psig, and elevated temperatures ranging from about 650° to 800° F., depending upon the feedstock employed and the degree of desulfurization required.

These types of catalytic processes are generally quite efficient when particular types of feedstocks are being processed, but they become of increased complexity and expense, and decreasing efficiency, as increasingly heavier feedstocks, such as whole or topped crudes and residua are employed. As an additional complicating factor, such residuum feedstocks often are contaminated with heavy metals, such as nickel, vanadium and iron, as well as with asphaltenes, which tend to deposit on the catalyst and to deactivate them. Furthermore, the sulfur contained in these feedstocks is generally contained in the higher molecular weight molecules which can only be broken down under the more severe operating conditions, and which thus tend to degrade the feedstock due to thermal cracking, with consequent olefin and coke formation and acceleration of the catalyst deactivation which occurs in these processes. Finally, no significant hydroconversion has been realized in these processes in conjunction with feed desulfurization and these processes have thus been employed in addition to conventional conversion processes, such as catalytic cracking, hydrocracking, etc.

As an alternative hydrodesulfurization process, molten dispersions of various alkali metals, such as sodium and alkali metal alloys, such as sodium lead, have been employed as desulfurization agents. Basically, these processes have involved the contacting of a hydrocarbon fraction with such an alkali metal or sodium dispersion, wherein the sodium reacts with the sulfur to form dispersed sodium sulfide ($Na_2S$). Such a process is taught in U.S. Pat. No. 1,938,672 wherein such alkali metals are employed in a molten state. These processes, however, have suffered from several distinct disadvantages. Specifically, they have included relatively low desulfurization efficiencies, partially due to the formation of substantial amounts of organo-sodium salts, the tendency to form increased concentrations of high molecular weight polymeric components, such as asphaltenes, and the failure to adequately remove metal contaminants from the oil. In addition, it has in the past been exceedingly difficult to resolve the resultant alkali metal salts-oil mixtures and regenerate alkali metals therefrom. Furthermore, none of these processes has been very useful in effecting any hydroconversion of the feedstocks employed during such desulfurization, and particularly not without any significant coke formation therein. Recently, however, U.S. Pat. No. 3,788,978, assigned to Exxon Research and Engineering Company, the assignee of the present invention, disclosed a process which included means for resolving the desulfurized oil-alkali metal salt mixtures. Furthermore, U.S. Pat. No. 3,878,315, also assigned to Exxon Research and Engineering Company, disclosed that such alkali metal desulfurization, when carried out in the presence of low pressure hydrogen, resulted in improved efficiency, whereby less sodium was required in order to remove given amounts of sulfur. Furthermore, improved demetallization and elimination of sludge formation was also obtained therein. Again, however, the simultaneous desulfurization and hydroconversion of the feeds employed is not effected in these processes.

In U.S. Pat. No. 3,354,081, also assigned to Exxon Research and Engineering Company, the assignee of the present invention, a process for sulfur removal from petroleum residuum is disclosed in which potassium sulfide is employed at elevated temperatures. This patent, however, does not relate to any hydrodesulfurization processes whatsoever, nor to the use of potassium sulfide in any such processes or in any processes where combined desulfurization and hydroconversion is obtained with regard to the feed employed therein.

Finally, in a series of recent applications also filed in the name of Exxon Research and Engineering Company, there have been disclosures regarding simultaneous desulfurization and hydroconversion of various petroleum feedstocks by the utilization of various alkali and alkaline earth metal compounds under various conditions. In Ser. No. 571,904, filed on Apr. 28, 1975, now abandoned for CIP Ser. No. 733,084 (now U.S. Pat. No. 4,087,348) alkaline earth metal hydrides and alkaline earth metal oxides are disclosed for such purposes utilizing increased hydrogen partial pressures therein. In Ser. No. 571,903, also filed on Apr. 28, 1975 (now U.S. Pat. No. 4,076,613), it is disclosed that alkali metals can also be used for such purposes, and at least 50 weight percent sulfur reduction and at least a reduction of the 1050° F.$^+$ fraction as well as a significant decrease in Conradson carbon and increased API gravity of the hydrogenated products can be obtained therewith. Finally, in U.S. Pat. No. 3,976,559 a combined hydrodesulfurization and hydroconversion process including initial contact with a hydrodesulfurization catalyst selectively avoiding conversion of the asphaltene aglomerates in metal-containing compounds therein is disclosed, along with subsequent contact with an alkali metal for combined desulfurization and hydroconversion to lower boiling products. Similarly, U.S. Pat. No. 4,003,823 discloses the combined desulfurization and hydroconversion of heavy carbonaceous feeds by contacting with alkali metal hydroxides.

U.S. Pat. No. 2,950,245 discloses the distillation of various petroleum oils in the presence of alkali metal hydroxides, among other substances, and including potassium, sodium, and other alkali metal hydroxides. This distillation occurs to an end point of about 800° F., to produce a distillate product and a coke residue. This patentee, however, does not teach contacting, in the presence of hydrogen, in order to both desulfurize and convert such heavy hydrocarbon feedstocks.

The search has thus continued for improved desulfurization and hydroconversion processes which can be realized with low coke production, etc., and for improved methods for carrying out such processes and regenerating the products produced by the contacting of the desulfurization agent and the sulfur-containing feed in the contacting zone.

SUMMARY OF THE INVENTION

In accordance with the present invention, it has now been discovered that one particular alkali metal sulfide, namely potassium sulfide, is of unexpectedly superior significance in connection with the simultaneous desulfurization and hydroconversion of various sulfur-containing hydrocarbon feedstocks. It has therefore been discovered that these results can be obtained in the presence of potassium sulfide by contacting such heavy hydrocarbon feedstocks, including whole or topped crudes, or various residua, with potassium sulfide in a conversion zone, in the presence of sufficient added hydrogen to produce a hydrogen pressure of from about 500 to 5,000 psig, wherein the conversion zone is maintained at elevated temperatures, so that the heavy hydrocarbon feedstocks are converted to lower boiling hydrocarbon products, and are simultaneously desulfurized, demetallized, etc.

The reaction products produced as a result of this procedure comprise a desulfurized, upgraded petroleum oil, and a limited amount of potassium hydrosulfide, i.e. preferably less than about 50 weight percent. The latter may be converted back into potassium sulfide by various regeneration processes, preferably including steaming to form potassium hydroxide which then reacts with the potassium hydrosulfide to yield potassium sulfide, or reduction of the potassium hydrosulfide.

In a preferred embodiment, however, a combination of potassium sulfide and sodium sulfide is employed in the conversion zone. In this manner, excellent conversion activity is obtained, but in addition a reagent is being utilized which is easily regenerated by a relatively simple thermal treatment.

BRIEF DESCRIPTION OF THE DRAWINGS

The present invention may be further understood with reference to the following figures, in which.

DETAILED DESCRIPTION OF THE INVENTION

Figure 1:
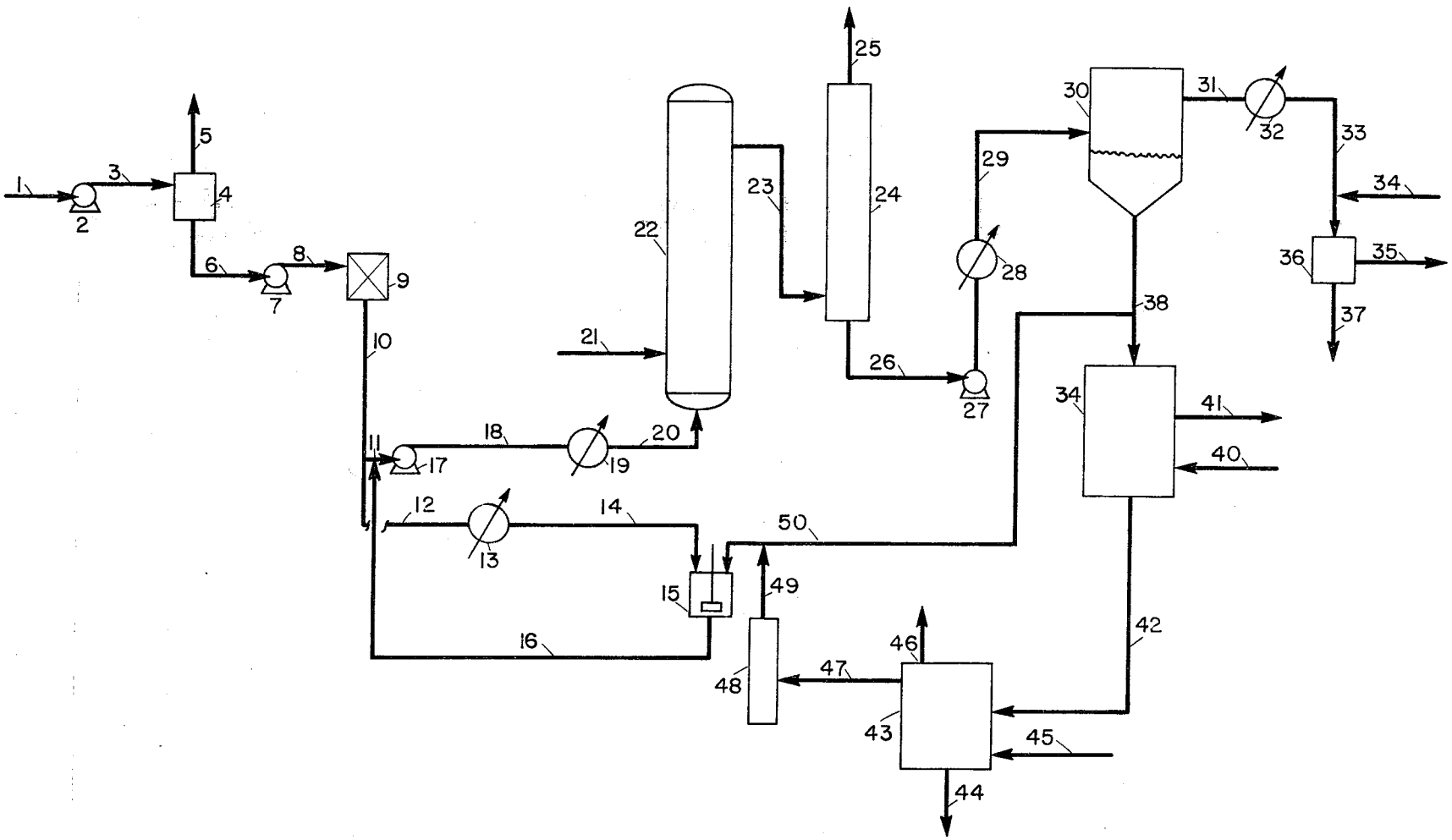
FIG. 1 is a schematic representation of the process of the present invention.

The process of the present invention is generally applicable to any sulfur-bearing feedstock. Thus, while the process is applicable to distillates, it is particularly effective when utilized to treat heavy hydrocarbons, such as those containing residual oils. Preferably, therefore, the process of this invention is utilized for the treatment of whole or topped crude oils and residua. Crude oil is obtained from any area of the world such as the Middle East, eg., Safaniya, Arabian heavy, Iranian light, Kuwait, etc., the U.S. or Venezualian, eg. Laquinillas, Tiajuana, Bachaquero, etc., as well as heavy gas oils, shale oils, heavy catalytic cycle oils, tar sands or syncrudes derived from tar sands, coal oils, bitumen derived from tar sands, coal and asphaltenes can be treated by the process of this invention. Additionally, both atmospheric residuum (boiling above 650° F.) and vacuum residuum (boiling above about 1050° F.) can be treated. Preferably, the feedstock is a sulfur-bearing heavy hydrocarbon oil having at least about 10 percent of materials boiling above 1050° F., more preferably at least about 25 percent of materials boiling above 1050° F.

These feedstocks may be directly introduced into the conversion zone for desulfurization and hydroconversion without any pretreatment. It is also generally desirable to desalt the feedstock to prevent NaCl contamination of the potassium salt products of the desulfurization reaction. Such desalting is generally effected in a conventional manner by adding small amounts of water to the feed to dissolve the salt followed by the use of electrical coalescers. The oil may then be dehydrated by conventional means.

The potassium sulfide may be charged to the conversion zone in several manners. For example, it can be employed in a slurry with the hydrocarbon feed itself, or fixed or fluidized bed processing can be employed. The potassium sulfide itself can be used either in an unsupported form or on a support, such as carbon, silica, alumina, coke, or other such support materials. The latter case is, of course, particularly useful when the process of this invention is employed in a fixed or fluidized bed process. In a slurry reactor, the potassium sulfide should be charged as a finely divided powder (eg. 100 to 200 mesh) to provide a good dispersion of that salt.

While the potassium sulfide may thus be charged to the conversion zone as such, it may also be generated in situ from the reaction of appropriate potassium compounds with a sulfur source. Appropriate potassium compounds can include potassium metal, and/or potassium hydride, hydroxide, oxide, carbonate, amide, alkoxides, aryloxides, alkyls, aryls, carboxylates, etc. Suitable sources of sulfur include various organic sulfur compounds, hydrogen sulfide, or the feedstock sulfur itself if utilized under proper conditions. It is also possible to produce potassium sulfide by the reduction of various other potassium compounds, such as sulfate, sulfite, thiosulfate, hydrosulfide, hydrosulfite, hydrosulfate, polysulfides, etc. In these processes, various reducing agents are employed in order to obtain such reduction, including hydrogen, carbon, coke, metal hydrides, alkyl metals, metals, etc. Finally, potassium sulfide can also be produced by the reaction of potassium hydrosulfide with a basic potassium compound such as potassium hydroxide, or potassium oxide, amide, alkoxides, aryl oxides, alkyls, aryls, and other suitable potassium sources, or by high temperature steaming of potassium hydrosulfide.

The amount of potassium sulfide employed generally may range from about 1 to about 50 percent by weight of the feedstock, preferably from about 1 to about 20 percent by weight thereof, and most preferably from about 1 to 15 percent by weight, depending upon the sulfur content of the feedstock, the degree of desulfurization desired, the level of hydroconversion desired, etc. Thus, from about 1 to about 3 moles of potassium sulfide per mole of sulfur in the feedstock can be employed, and preferably from about 1 to about 2 moles of potassium sulfide per mole of feed sulfur.

The hydrogen-containing gas is introduced into the contacting zone as either pure hydrogen (for example, from a steam reforming process) or as a diluted hydrogen gas stream (for example, that from refinery discard streams, e.g., subsequent to hydrotreating processes, gas effluent from cat cracker or reformer light end streams, naphtha reformer recycle hydrogen streams, and the like).

The contacting of the hydrocarbon feedstock with the potassium sulfide may be carried out in various conventional manners, including operation in batch or continuous processes, staged treating, etc. The contacting of the potassium sulfide, hydrogen and the feedstock is thus carried out under conditions designed to maintain the bulk of the feedstock in the liquid phase and to effect desulfurization and substantial hydroconversion thereof. Thus, the reaction of the feedstock, potassium sulfide and hydrogen can be carried out at a temperature within the range of from about 500° to 2000° F., preferably from about 500° to 1500° F., most preferably between about 750° and 1,000° F. However, where a substantial degree of conversion of the 1050° F.+ bottoms portion of the feedstock, such as above about 50 percent of these components, is desired, the conversion temperature employed should exceed about 750° F., most preferably above about 800° F.

Furthermore, hydrogen partial pressure within the range of from about 500 to 5,000 psig, preferably from about 1,000 to 5,000 psig, and most preferably between about 1,500 and 3,000 psig are utilized.

In the preferred embodiment of the present invention discussed above wherein a combination of potassium sulfide and sodium sulfide is employed, these sulfides can be charged to the conversion zone either as an intimate physical mixture, or separately. They can be impregnated upon each other using suitable impregnating solvents, including such suitable solvents as water, organic alcohols such as methanol, ethanol, etc., ethers such as diethyl ether, ketones such as acetone, etc. Furthermore, as discussed above with respect to potassium sulfide, the sodium sulfide can also be introduced into the conversion zone as such, or produced in situ, again in this case by reaction of a suitable sodium source with a source of sulfur as discussed above. The sodium sources which can be used are equivalent to each of the potassium sources discussed above. Again, sodium sulfides can also be prepared by reaction of the hydrosulfide with various reducing agents, or by other such processes as outlined above.

In the preferred embodiment where a combination of potassium and sodium sulfides is employed, while the total amount of sulfide charged to the conversion zone will be in the amounts discussed above with respect to potassium sulfide, the ratio between the two sulfides may be varied within a wide range. Preferably, an amount of sodium sulfide is employed at least about 1 to 50 weight percent based on the feed, preferably about 1 to 25 weight percent. The ratio between the potassium and sodium sulfide may range from about 50 to 1 to about 1 to 50, but preferably from about 10 to 1 to about 1 to 10, and most preferably from about 1 to 1 to 1 to 5.

The process of the present invention may be further understood by reference to the figures herein, wherein like numerals refer to like portions thereof.

Referring to FIG. 1, a sulfur-containing residual feedstock preheated to a temperature of between about 400 and 700° F. is fed through line 1, and pump 2, into line 3, and finally into separator 4 where water and light gases are removed overhead through line 5. As discussed above, the feed will have been previously desalted by conventional means, not shown in the figure, and the feed then exits by line 6 from separator 4 and is pumped by pump 7 through line 8 into filter 9 where scale and particulates may be removed. The feed then leaves the filter 9 through line 10 which divides into two streams, designated by lines 11 and 12 in FIG. 1. The portion in line 12 is fed through exchanger 13 into line 14, and finally into mixing vessel 15 where a dispersion is formed with potassium sulfide entering from line 50. Mixing vessel 15 is a dispersator design providing for high shear mixing therein, and includes conditions of temperature between about 400° and 650° F. and a pressure between about 50 and 500 psig with holding times of from 30 to 60 minutes. The salt-oil dispersion is then removed from mixer 15 through line 16 and combined with the balance of the feed in line 11 discussed above. This stream then enters the charging pump 17 where the pressure is raised to about 1500 psig and the dispersion then passes through line 18, through heat exchanger 19, where the temperature is raised to a temperature of between about 750° and 800° F., and then into reactor 22 through line 20. Hydrogen enters reactor 22 through line 21 in amounts such that the partial pressure of hydrogen in the reactor is between about 1500 and 2500 psig. Reactor 22 is preferably baffled to promote contacting between the potassium sulfide and the oil and to prevent bypassing from the inlet to the outlet therein. Holding times in reactor 22 generally range from about 15 to 60 minutes, preferably about 30 minutes, and the temperature at the top of the reactor 22 is generally about 850° F., but can range as high as about 900° F.

The oil dispersion leaving reactor 22 through line 23 is passed to stripper tower 24 where the pressure is lowered to about 100 psig. Light hydrocarbons, excess hydrogen, and hydrogen sulfide may then be removed overhead through line 25 for subsequent condensation, depressurization, and separation by conventional means not shown in the figure. Hydrogen may be recycled to reactor 22 and light hydrocarbon products can be directed to storage. Hydrogen sulfide can be converted in a Claus plant for sulfur recovery. The oil-salt mixture is then removed from tower 24 through line 26, and pump 27, to heat exchanger 28 where the temperature is adjusted to between about 500° and 750° F., and the mixture then fed through line 29 into separator 30 where the mixture readily disengages into an upper desulfurized oil phase and a lower potassium sulfide-coke phase. Separator 30 is generally operated at a temperature of between about 500° and 750° F., and a pressure of between about 50 and 1,000 psig, and the product oil can be removed therefrom through line 31, into heat exchanger 32 where the temperature is reduced to between about 250° and 300° F., and then through line 33 into which an acid, such as dilute sulfuric or acetic acid, can be injected via line 34 in order to remove any residual inorganic salts therein. Electrostatic precipitator 36 can thus be used to direct a product oil through line 35 to storage or downstream processing, while the aqueous phase can be rejected through line 37 and discarded.

Potassium sulfide bearing entrained coke may be withdrawn from separator 30 through line 38 into coke purge vessel 39. The potassium sulfide is solubilized by the addition of water or a lower organic alcohol, such as methanol or ethanol, and coke purge vessel 39 may be operated at a temperature of between 150° and 500° F. and a pressure of between about 50 and 500 psig. The amount of solvent employed is determined by the quantity required to provide a liquid or molten, potassium sulfide phase under the conditions employed in purge vessel 39. Coke is removed through line 41 by conventional skimming or slagging techniques, or by other conventional means such as centrifugation, filtration, and the like. The liquid potassium sulfide stream is then directed to stripper 43 through line 42. The stripper vessel 43 is generally operated at a temperature of between 200° and 700° F., and a pressure of between about 50 and 1,000 psig so as to recover the solvent for recycle to coke purge vessel 39. An inert stripping gas, such as hydrogen, nitrogen, methane, etc., is introduced through line 45 into stripper vessel 43 in order to facilitate removal of the solvent therefrom. The solvent and the gas exit through line 46 subsequent to which they may be separated for recycle by conventional means again not shown in FIG. 1. During the stripping operation, the pH of the salt solution may be adjusted to precipitate metals removed from the oil during the reaction. The metal sludge can be separated and removed through line 44 and directed to metals reclamation equipment. Any potassium hydroxide and potassium hydrosulfide entering or formed in vessel 43 will react in situ to form potassium sulfide therein. The potassium sulfide then leaves stripper vessel 43 through line 47 into dryer 48 where the final traces of solvent may be removed, and is then directed through line 49 to line 50 for charging into mixing vessel 15, as discussed above.

Either a portion or all of the coke-bearing potassium sulfide may be directed to coke purge vessel 39 and stripper vessel 43, depending upon the coke and metals content of the sulfide and the frequency of removal of these contaminants therefrom. The bulk of the potassium sulfide withdrawn from separator 30 may be recycled directly through line 50 to mixing vessel 15, while a slip stream may pass through line 38 into coke purge vessel 39. Stripper vessel 43 can also serve to convert by-product potassium hydrosulfide into potassium sulfide by decomposition with high pressure steam. When such regeneration is desired, water may be fed into coke purge vessel 39, and the aqueous salt solution may enter vessel 43 through line 42. Steam may enter stripper vessel 43 through line 45, and hydrolysis of potassium hydrosulfide to potassium hydroxide will occur, with hydrogen sulfide leaving with the steam in line 46. The potassium hydroxide reacts with potassium hydrosulfide to yield the sulfide in situ, and the excess water is then stripped from the salt as described hereinabove. Steaming in vessel 43 requires temperatures ranging from about 300° to 700° F. and pressures of from about 100 to 1,000 psig.

It has been found that in many instances when potassium sulfide alone is employed for such hydroconversion processes, potassium hydrosulfide tends to form when combined with the hydrogen sulfide produced in the reaction zone. While the potassium hydrosulfide thus produced can be regenerated by procedures discussed above, including high temperature steaming, or reduction by various chemical reducing agents, these processes would tend to complicate the process employed and to make it less economically attractive. It has therefore been found that when a combination of potassium sulfide and sodium sulfide is employed, highly superior results can be obtained. Thus, the presence of the sodium sulfide, which when used alone provides quite inferior results with regard to possible hydrodesulfurization and hydroconversion of the feed itself, in effect intercepts the hydrogen sulfide to prevent it from reacting with the potassium sulfide. While it would therefore be potentially feasible to employ other hydrogen sulfide acceptors in place of the sodium sulfide, such as various inorganic bases, including hydroxides, oxides, carbonates, amides, etc., each of these tend to bind irreversibly with the hydrogen sulfide. The reaction of sodium sulfide and hydrogen sulfide is, however, reversible, and may be represented by the following equilibrium; $2\ NaSH = Na_2S + H_2S$ at about 400° F. The equilibrium constant in this reaction can be influenced by temperatures and pressures, so that by increasing the pressure capture of the hydrogen sulfide by sodium sulfide would be favored. In this manner, in the reaction zone, the sodium and hydrogen sulfides combine, apparently preferentially thereby minimizing the production of inactive potassium hydrosulfide as discussed above. The hydrogen sulfide may then be simply purged by thermotreatment of the resulting sodium hydrosulfide to again produce sodium sulfide and hydrogen sulfide therefrom.

Figure 2:
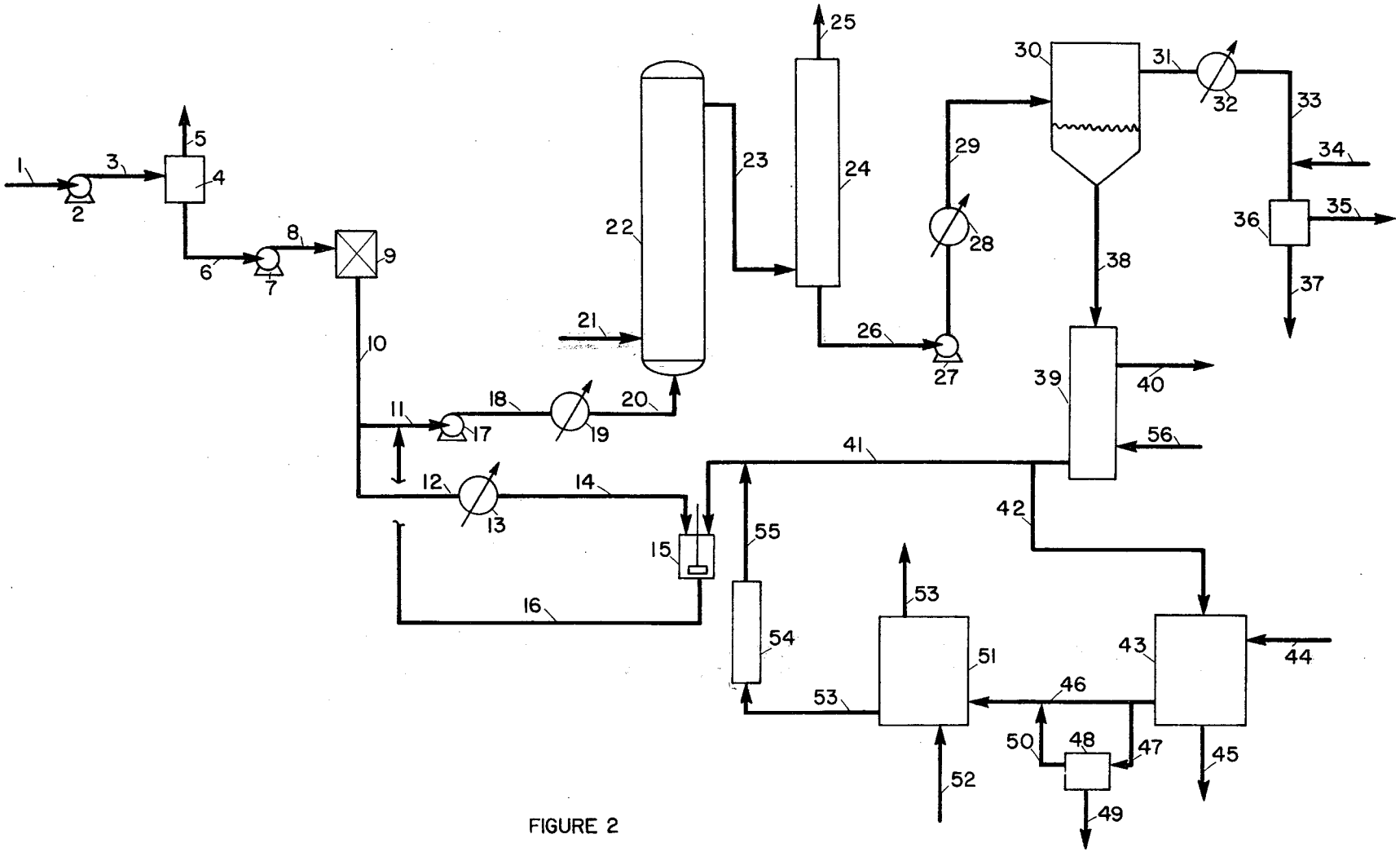
FIG. 2 is a schematic representation of another embodiment of the process of the present invention.

Referring now to FIG. 2, a sulfur-containing feed preheated to a temperature of between about 400 and 700° F. is fed through line 1, and pump 2, into line 3, and finally into separator 4 where water and light gases are withdrawn overhead through line 5. This feed may have been previously desalted by conventional means not shown in the Figure, as discussed above. The feed then exits through line 6 and is pumped by pump 7 through line 8 into filter 9 where scale and particulates are removed. The feed then leaves the filter 9 through line 10 and is divided into two streams, namely lines 11 and 12 as shown in FIG. 2. The portion of this feed fed through line 12 is then fed through heat exchanger 13 and through line 14 into mixing vessel 15 where a dispersion is formed with the potassium and sodium sulfides entering the mixing vessel 15 through line 41. Mixing vessel 15 is again of a dispersator design providing for high shear mixing, and includes a temperature of between about 400° and 650° F. and a pressure of between about 50 and 500 psig with holding time of between about 30 and 60 minutes. The salt-oil dispersion formed therein is removed through line 16, and can then be combined with the balance of the feed in line 11 as discussed above. This stream enters the charging pump 17 where the pressure is raised to a pressure of about 1500 psig, and the feed then passes through line 18, through heat exchanger 19, where the temperature is raised to a temperature of between about 750° and 800° F., and then into reactor 22 through line 20. Hydrogen is fed into reactor 22 through line 21 in amounts such that the partial pressure of hydrogen in the reactor is between about 1500 and 2500 psig. Reactor 22 may again preferably be baffled to promote contacting between the potassium and sodium sulfides and the oil and to prevent bypassing from the inlet to the outlet, and again holding times ranging from about 15 to 60 minutes, preferably about 30 minutes, will be employed in the reactor 22. The temperature at the top of the reactor will be about 850° F., but can range as high as about 900° F.

The potassium sulfide-sodium hydrosulfide oil dispersion then leaves reactor 22 through line 23 and is fed into stripper tower 24 where the pressure may then be lowered to about 700 psig, and light hydrocarbons and excess hydrogen removed overhead through line 25 for subsequent condensation, depressurization, and separation by conventional means not shown in FIG. 2. Hydrogen may be recycled to the reactor, and light hydrocarbon products directed to storage. The oil-salt mixture is then removed from stripper tower 24 through line 26, and pump 27, into heat exchanger 28 where the temperature may be adjusted to between about 700° and 750° F. The stream then passes through line 29 into separator 30 where the mixture readily disengages into a product oil upper phase and a lower phase containing potassium sulfide, sodium hydrosulfide, unconverted sodium sulfide, coke, and metals removed from the feed. The separator 30 is maintained at a temperature of between about 700° and 750° F. and a pressure of between about 500 and 800 psig, and the product oil is removed through line 34, through heat exchanger 32, where the temperature is lowered to between about 200° and 250° F., and then through line 33 to electrostatic precipitator 36. Once again, dilute sulfuric or acetic acid can be injected through line 34 into this product to remove any residual inorganic salts contained therein. The final product will exit through line 35 for storage or downstream processing, while the aqueous phase is rejected through line 37.

The bottom inorganic phase withdrawn from separator 30 through line 38 passes into decomposition tower 39 where hydrogen sulfide is removed to regenerate the sodium sulfide therefrom. Tower 39 will thus be operated at a temperature of between about 200° and 700° F., and at a pressure ranging from about atmospheric to 200 psig. An inert stripping gas may be introduced through line 56 to facilitate removal of hydrogen sulfide, and suitable gases such as hydrogen, nitrogen, methane, steam, methanol, ethanol, etc. employed therein. The gas stream exists tower 39 through line 40 for further treatment by conventional means not shown in FIG. 2. Hydrogen sulfide may thus be directed to a Claus plant for sulfur recovery, and the stripping gas may be recovered for recycle to tower 39. The reconstituted potassium sulfide-sodium sulfide mixture may then be recycled to mixing vessel 15 through line 41 as discussed above.

A portion or the entire amount of potassium sulfide-sodium sulfide mixture may then be directed to vessel 43 for coke removal, as required. The salt blend is thus solubilized by the addition of water, or methanol or ethanol or the like, through line 44. Vessel 43 is thus operated at a temperature of between about 150° and 500° F., and a pressure of between about 50 and 500 psig. The amount of solvent employed is determined by the amount required to provide a liquid or molten metal sulfide phase at the operating conditions employed in vessel 43. Coke is purged therefrom through line 45 by the use of conventional skimming or slagging techniques or by other conventional means such as centriguation, filtration, or the like. The liquid metal sulfide stream then passes into stripper vessel 51 through line 46 from vessel 43. A slip stream may be diverted through line 47 from line 46 into vessel 48 where metals can be removed from the feed and recovered if desired. Metals are thus separated through line 49 after being precipitated by proper pH adjustment or solvent extraction, both of which are conventional techniques known in the art. The slip stream thus ultimately passes into stripper 51 through lines 50 and 46. Stripper 51 is thus operated at temperatures of between about 200° and 700° F., and pressures of between about 50 and 1000 psig in order to recover the solvent for recycle to the coke purge vessel 43. A stripping gas, such as hydrogen, nitrogen, or methane, is thus introduced through line 52 to facilitate the stripping operation therein. The solvent and stripping gas are removed overhead through line 53 and separated for recycle by conventional means again not shown in FIG. 2. The sulfide mixture is then transferred through line 53 to dryer 54 where final traces of solvent may be removed, and the potassium sulfide-sodium sulfide mixture may then be returned through line 55 into line 41 and finally into mixing vessel 15.

The present invention may be more clearly understood with reference to the following examples.

EXAMPLES 1-9

Each of these examples are shown in Table I. A Safaniya atmospheric residuum having the inspection shown in Table I was utilized under the conditions shown in each case. In Example 1, a control run was carried out to demonstrate the degree of cracking and coking which occurs under these hydroconversion conditions without any reagent being present in the conversion zone. In Examples 2-6, the ineffectiveness of a variety of Group IA and IIA metal sulfur compounds for combined hydroconversion and desulfurization is illustrated. It is thus particularly noted that in these cases that the coke and gas yields remained unacceptedly high while product quality was only slightly improved.

In Examples 7-9, carried out in accordance with the present invention utilizing potassium sulfide as the hydroconversion reagent, the production of a maximized liquid product of highly improved quality is demonstrated.

EXAMPLES 10-11

In these examples, again carried out in accordance with the process of the present invention (see Table II), potassium sulfide is generated in situ by the reaction of potassium hydrosulfide with potassium hydroxide. The results again demonstrate the improved combined hydroconversion and desulfurization effect of potassium sulfide herein.

EXAMPLES 12-13

In these Examples (see Table II) again carried out in accordance with the process of the present invention, previously desulfurized feedstocks were employed, including a desulfurized Safaniya atmospheric residuum in Example 12 and the product of a conventional Residfiner in Example 13. In both cases, the results indicate the improved combined hydroconversion and further desulfurization of this invention, so

TABLE I

HYDROCONVERSION OF RESIDUA WITH POTASSIUM SULFIDE

Feed: Safaniya Atmospheric Residua
Conditions: Batch runs, 1 hr., 820° F, 1700 psig $H_2$

| Example No. | | 1 | 2 | 3 | 4 | 5 | 6 | 7 | 8 | 9 |
|---|---|---|---|---|---|---|---|---|---|---|
| Reagent, | | — | $Na_2S$ | NaSH | KSH | CaS | BaS | $K_2S$ | $K_2S$ | $K_2S$ |
| Wt. % on Feed | | — | 9 | 10 | 9 | 11 | 21 | 23 | 12 | 7 |
| $C_5^-$ gas, wt. % | | 14.0 | 5.0 | 5.4 | 6.2 | 4.2 | 5.8 | 2.0 | 1.4 | 2.1 |
| Coke, wt. % | | 10.0 | 5.3 | 4.1 | 8.3 | 9.5 | 7.9 | 1.3 | 1.5 | 2.3 |
| Inspections | (Feed) | | | | | | | | | |
| Sulfur, wt. % | 3.9 | 3.2 | 2.8 | 3.3 | 2.7 | 2.9 | 2.8 | 1.4 | 2.0 | 2.3 |
| Con. carbon, wt. % | 12.1 | 3.6 | 8.8 | 9.2 | 7.9 | 7.3 | 6.7 | 5.6 | 6.5 | 7.0 |
| Ni/V/Fe, ppm | 101 | 22 | 26 | 49 | 12 | 16 | 34 | 7 | 10 | 8 |
| API gravity | 14.4 | 24.4 | 26.5 | 22.3 | 29.1 | 29.7 | 28.2 | 25.6 | 26.1 | 28.1 |
| Asphaltenes, wt. % | 17.0 | — | 3.9 | — | 7.1 | 8.1 | 4.3 | 3.7 | 5.1 | 5.6 |
| 1050° F−, vol. % | 59 | 85 | — | — | — | — | — | — | 90 | — |
| Desulfurization % | | — | 38 | 25 | 40 | 35 | 38 | 65 | 51 | 45 |
| Demetallization % | | — | 78 | 57 | 90 | 86 | 71 | 93 | 89 | 92 |
| Con. carbon conversion % | | — | 36 | 24 | 44 | 48 | 52 | 55 | 48 | 44 |
| 1050° F+ conversion % | | — | — | — | — | — | — | — | 76 | |

TABLE II

HYDROCONVERSION OF RESIDUA WITH POTASSIUM SULFIDE

Feed: A. Safaniya Atmospheric Residuum
B. Desulfurized Safaniya Atmospheric Residuum
C. Residfiner Product Conditions: Batch runs, 820° F, 1700 psig $h_2$, 1 hr.

| Example No. | | 10 | 11 | | 12 | | 13 |
|---|---|---|---|---|---|---|---|
| Feed | | A | A | | B | | C |
| Reagent, wt. % on feed | | KOH, 8 KSH, 9 | KOH, 14 KSH, 18 | | KOH, 7 KSH, 9 | | KOH, 5 KSH, 6 |
| $C_5^-$ gas, wt. % | | 1.6 | 2.9 | | 1.9 | | 2.7 |
| Coke, wt. % | | 1.9 | 1.9 | | 0.7 | | 0.6 |
| Inspections | (Feed) | | | (Feed) | | (Feed) | |
| Sulfur, wt. % | 3.9 | 1.4 | 1.4 | 1.7 | 1.0 | 0.6 | 0.2 |
| Con. carbon, wt. % | 12.1 | 5.6 | 5.0 | 7.1 | 3.5 | 7.8 | 4.4 |
| Ni/V/Fe, ppm | 101 | 8 | 6 | 9 | 3 | 54 | 3 |
| API gravity | 14.4 | 27.2 | 27.2 | 20.9 | 25.9 | 18.3 | 26.4 |
| Desulfurization % | | 66 | 66 | | 43 | | 60 |
| Demetallization % | | 92 | 94 | | 69 | | 94 |
| Con. carbon conversion % | | 55 | 60 | | 53 | | 45 |

that a feed suitable for conventional hydrodesulfurization or catalytic cracking is produced in Example 12, while a suitable catalytic cracking feed is also produced in Example 13.

EXAMPLE 14

In Example 14 (See Table III), again utilizing a Safaniya Atmospheric Residuum feedstock having the inspections shown, the ineffectiveness of potassium hydrosulfide for hydroconversion is shown, both by the high coke and gas yields produced therein.

EXAMPLES 15-16

While Example 15 (see Table III) is carried out in accordance with the process of the present invention, Example 16 was carried out at the same conditions, except that sodium sulfide was substituted for potassium sulfide, and its poor quality as a combined hydroconversion and desulfurization reagent is demonstrated by increased gas and coke yields in addition to the poor quality of the product produced.

EXAMPLES 17-18

In Examples 17 and 18 (see Table III), the process of the present invention utilizing a mixture of potassium and sodium sulfides is demonstrated. In these examples, the improved combined hydroconversion and desulfurization results are shown, while in Example 18 this is accomplished with varied reaction times and temperatures. In the latter case, this is particularly significant in that the reaction temperature was increased without the expected increase in coking and/or cracking.

EXAMPLE 19

In Example 19 (see Table III), again carried out in accordance with the process of the present invention employing a mixture of potassium and sodium sulfides, the ratio of these reagents was, however, altered by reducing the concentration of the potassium sulfide, and while the product quality was adversely affected, the overall yield pattern was not.

EXAMPLE 20

Example 20 (see Table III) was carried out in a manner similar to Example 18, except that the feed utilized in this case was a tar sands Bitumen having the inspections shown on the far right hand column of Table III. The results obtained again demonstrate the combined hydroconversion and desulfurization attained in accordance with this invention.

EXAMPLE 21

Example 21 was carried out in accordance with the procedure shown in Example 17, except that fresh hydrogen was pressured into the conversion zone after thirty minutes. The results obtained included the following;

| | | | |
|---|---|---|---|
| $C_5$— gas, wt. % | 2.2 | | |
| Coke, wt. % | 1.0 | | |
| Sulfur, wt. % | 1.4 | Desulfurization % | 65 |
| Con. carbon, wt. % | 5.6 | | |
| Ni/V/Fe,ppm | 12 | Con. carbon conversion % | 55 |
| API gravity | 25.3 | | |
| Asphaltenes, wt. % | 3.9 | Demetallization % | 89 |

As demonstrated therein, hydrogen staging resulted in lower coke yield thus further improving the overall process. Continuous processing will thus appear to improve both liquid yield and quality.

EXAMPLE 22

Example 22 was carried out in accordance with the procedure of Example 15, except that the product was withdrawn from the separated salt, and a fresh charge of the same feed oil was added to the conversion zone. This recycle procedure was repeated two more times so that a total of 400 grams of feed was processed over the initial charge of 14 grams of potassium sulfide. The results obtained included the following;

| Cycle No. | 1 | 2 | 3 | 4 |
|---|---|---|---|---|
| $C_5$—gas, wt. % | 2.3 | 2.8 | 4.5 | 4.5 |
| Coke, wt. % | 2.0 | 2.5 | 6.2 | 6.2 |
| Desulfurization % | 60 | 31 | 40 | 24 |
| Con. carbon conv. % | 50 | 36 | 47 | 29 |
| Demetallization % | 94 | 89 | 78 | 79 |

The results obtained again demonstrate the decline in activity with increase in potassium hydrosulfide concentration, but in this case, the presence of sodium sulfide lowers the rate of activity loss.

EXAMPLE 24

Example 24 was carried out in accordance with the procedure of Example 17, except that in this case, the product oil was withdrawn and replaced with a fresh charge of feed oil a total of ten times, so that a total of 1,000 grams of feed was processed over the initial charge of reagent. In this case, however, after each withdrawal of feed and prior to introduction of fresh feed, hydrogen sulfide was purged from the reagents by heating the reagent mixture to a temperature of from 400° to 600° F., with a nitrogen sweep. The results obtained included the following;

| Cycle No. | 1 | 2 | 3 | 4 | 5 | 6 | 7 | 8 | 9 | 10 |
|---|---|---|---|---|---|---|---|---|---|---|
| $C_5$— gas, wt. % | 1.3 | 1.0 | 3.8 | 4.4 | 2.4 | 3.9 | 1.7 | 1.8 | 3.0 | 2.9 |
| Desulfurization | 64 | 48 | 44 | 48 | 49 | 43 | 43 | 49 | 39 | 34 |
| Con. Carbon Conversion % | 59 | 45 | 40 | 55 | 60 | 60 | 55 | 60 | 66 | 42 |
| Demetallization % | 90 | 81 | 85 | 91 | 91 | 91 | 90 | 88 | 75 | 75 |

As shown therein, hydrogen sulfide purge in this manner results in significant activity maintenance. Average coke yield was 2 weight percent per cycle.

TABLE III

HYDROCONVERSION OF RESIDUA WITH POTASSIUM SULFIDE-SODIUM SULFIDE

Feed: Safaniya Atmospheric Residuum
Conditions: Batch runs, 820° F., 1700 psig $H_2$, 1 hr.

| Example No. | | 14 | 15 | 16 | 17 | 18[a] | 19 | 20[b] | |
|---|---|---|---|---|---|---|---|---|---|
| | | KSH | $K_2S$ | $Na_2S$ | $K_2S$, 14 | $K_2S$, 15 | $K_2S$, 5 | $K_2S$, 15 | |
| Reagent, wt. % on feed | | 9 | 14 | 9 | $Na_2S$, 9 | $Na_2S$, 10 | $Na_2S$, 25 | $Na_2S$, 10 | |
| $C_5^-$ gas, wt. % | | 5.3 | 1.6 | 4.6 | 1.6 | 1.9 | 1.6 | 3.1 | |
| Coke, wt. % | | 8.3 | 1.9 | 5.3 | 1.9 | 1.8 | 1.9 | 1.0 | |
| Inspections (Feed) | | | | | | | | (Feed b) | |
| Sulfur, wt. % | 3.9 | 2.7 | 1.4 | 2.7 | 1.6 | 1.8 | 2.2 | 1.2 | 4.5 |
| Con. carbon, wt. % | 12.1 | 7.8 | 5.6 | 8.6 | 6.0 | 6.3 | 7.6 | 5.1 | 12.3 |
| Ni/V/Fe, ppm | 101 | 12 | 8 | 25 | 4 | 8 | 21 | 30 | 642 |
| API gravity | 14.4 | 29.1 | 27.2 | 26.5 | 26.3 | 25.7 | 24.6 | 23.3 | 10.3 |
| Asphaltenes, wt. % | 17.0 | 6.9 | 4.3 | 3.9 | 4.8 | 3.9 | 6.2 | 3.4 | — |
| 1050° F−, Vol. % | 59 | — | 90 | — | 88 | — | — | — | 58 |
| Desulfurization % | | 40 | 66 | 38 | 62 | 56 | 45 | 75 | |
| Con. carbon conversion % | | 47 | 55 | 37 | 52 | 51 | 40 | 60 | |
| Demetallization % | | 90 | 92 | 78 | 95 | 92 | 80 | 96 | |
| 1050° F+ Conversion % | | — | 76 | — | 71 | — | — | — | |

[a]850° F., 20 minutes, 1,800 psig $H_2$
[b]Tar Sands Bitumen

The results demonstrate the loss of activity which results from increase in the concentration of potassium hydrosulfide in the conversion zone.

EXAMPLE 23

Example 23 was carried out in accordance with the procedure of Example 17, except that the product oil was withdrawn and fresh charge added to the conversion zone in accordance with the procedure in Example 22, again for a total of 400 grams of feed processed over the initial charge of potassium and sodium sulfides. The results obtained included the following;

| Cycle No. | 1 | 2 | 3 | 4 |
|---|---|---|---|---|
| $C_5$— gas, wt. % | 1.9 | 1.7 | 4.0 | 4.5 |
| Coke, wt. % | 1.9 | 2.0 | 4.5 | 5.4 |
| Desulfurization % | 63 | 45 | 45 | 29 |
| Con. carbon conv. % | 57 | 41 | 47 | 25 |
| Demetallization % | 89 | 86 | 91 | 82 |

EXAMPLE 25

Example 25 was carried out in accordance with the procedure of Example 24, except that the procedure was carried out for a total of 26 cycles, so that a total of 2,628 grams of feed was processed over the initial charge of reagents. The average results obtained for the 26 cycles included the following;

| | | | |
|---|---|---|---|
| $C_5$— gas, wt. % | 3.2 | | |
| Coke, wt. % | 3.5 | | |
| Sulfur, wt. % | 2.7 | Desulfurization % | 39 |
| Con. carbon, wt. % | 6.9 | Con Carbon Conversion % | 50 |
| Ni/V/Fe,ppm | 24 | Demetallization % | 81 |
| API Gravity | 26 | 1050° F+Conversion % | 85 |
| Asphaltenes, wt. % | 5 | | |
| 1050° F⁻, vol. % | 94 | | |

Analysis of the 1050° F− Distillate gave sulfur, 2.5%; Conradson carbon, 1.4%; Ni/V/Fe, 0/0/3 ppm; Nitrogen 0.12%. Fractionation of the 1050° F- product gave 43 wt. % $C_5$/430, 26% 430/650, and 650/1050.

The results again demonstrate the significant activity maintenance obtainable in accordance with this proces of the present invention when employing hydrogen sulfide purging as shown.

What is claimed is:

1. A process for the combined desulfurization and hydroconversion of a heavy hydrocarbon feedstock, which comprises contacting said heavy hydrocarbon feedstock without pretreatment with potassium sulfide in a conversion zone in the presence of a sufficient amount of added hydrogen to produce a hydrogen pressure of from about 500 to 5000 psi, in a conversion zone maintained at an elevated temperature between 500° and 2000° F., so that said heavy hydrocarbon feedstock is converted to lower boiling hydrocarbon products and is substantially desulfurized.

2. The process of claim 1 wherein said potassium sulfide is present in said conversion zone in an amount ranging from about 1 to 50 weight percent based on said hydrocarbon feedstock.

3. The process of claim 1 wherein said potassium sulfide is employed in a slurry with said heavy hydrocarbon feedstock in said conversion zone.

4. The process of claim 1 wherein said hydrogen pressure ranges from about 1500 to 3000 psi.

5. The process of claim 1 wherein said heavy hydrocarbon feedstock includes at least about 10 weight percent of components boiling above about 1050° F., and wherein at least about 50 percent of said components boiling above about 1050° F. are converted therein.

6. The process of claim 5 wherein said elevated temperature is greater than about 750° F.

7. The process of claim 1 wherein less than about 50 weight percent of potassium hydrosulfide is formed in said conversion zone, and wherein said potassium hydrosulfide is converted to potassium sulfide, and said potassium sulfide is recycled to said conversion zone.

8. The process of claim 7 wherein said potassium hydrosulfide is converted to said potassium sulfide by high temperature steaming of said potassium hydrosulfide to form potassium hydroxide, and said potassium hydroxide is contacted with hydrogen sulfide to produce said potassium sulfide.

9. The process of claim 1 wherein sodium sulfide is present in said conversion zone.

10. The process of claim 9 wherein the ratio of said potassium sulfide to said sodium sulfide is between about 50:1 and 1:50.

11. The process of claim 9 wherein said elevated temperature is between about 500° and 2000° F.

12. The process of claim 9 wherein said heavy hydrocarbon feedstock includes at least about 10 weight percent of components boiling above about 1050° F., and at least about 50 percent of said components boiling above about 1050° F. are converted to lower boiling products in said conversion zone.

13. The process of claim 9 wherein sodium hydrosulfide is produced in said conversion zone, and said sodium hydrosulfide is converted to said sodium sulfide by contacting said sodium hydrosulfide in a stripping zone maintained at a temperature between about 200° and 700° F.

* * * * *